US009079433B2

(12) United States Patent
Huang

(10) Patent No.: US 9,079,433 B2
(45) Date of Patent: Jul. 14, 2015

(54) SLEEVE AND MULTI-FUNCTION PRINTER

(75) Inventor: Jui-Chih Huang, New Taipei (TW)

(73) Assignees: Cal-Comp Electronics & Communications Company Limited, New Taipei (TW); Kinpo Electronics, Inc., New Taipei (TW)

( * ) Notice: Subject to any disclaimer, the term of this patent is extended or adjusted under 35 U.S.C. 154(b) by 373 days.

(21) Appl. No.: 13/550,613

(22) Filed: Jul. 17, 2012

(65) Prior Publication Data

US 2013/0029820 A1 Jan. 31, 2013

(30) Foreign Application Priority Data

Jul. 27, 2011 (TW) ..... 100126619 A

(51) Int. Cl.

| | |
|---|---|
| ***G03G 15/08*** | (2006.01) |
| ***G03G 15/09*** | (2006.01) |
| ***B05C 11/00*** | (2006.01) |
| ***B41J 13/076*** | (2006.01) |
| ***G03G 21/16*** | (2006.01) |
| *G03G 15/00* | (2006.01) |

(52) U.S. Cl.

CPC ..... *B41J 13/076* (2013.01); *G03G 21/1647* (2013.01); *G03G 15/757* (2013.01)

(58) Field of Classification Search

CPC .... B41J 13/076; B05C 11/00; G03G 15/0935
USPC ..... 399/276, 286; 492/48
See application file for complete search history.

(56) References Cited

U.S. PATENT DOCUMENTS

| | | | | | |
|---|---|---|---|---|---|
| 5,221,943 | A | * | 6/1993 | Hasegawa | 399/111 |
| 5,347,343 | A | * | 9/1994 | Ohtsuka et al. | 399/111 |
| 5,404,198 | A | * | 4/1995 | Noda et al. | 399/107 |
| 5,452,056 | A | * | 9/1995 | Nomura et al. | 399/111 |
| 5,583,618 | A | * | 12/1996 | Takeuchi et al. | 399/111 |
| 5,737,668 | A | * | 4/1998 | Johroku | 399/120 |
| 5,774,766 | A | * | 6/1998 | Karakama et al. | 399/111 |
| 5,809,377 | A | * | 9/1998 | Chiesa et al. | 399/111 |
| 5,854,955 | A | * | 12/1998 | Yawata et al. | 399/111 |
| 6,016,413 | A | * | 1/2000 | Yokoyama et al. | 399/113 |
| 6,029,031 | A | * | 2/2000 | Yokomori et al. | 399/109 |
| 6,097,909 | A | * | 8/2000 | Watanabe et al. | 399/111 |
| 6,249,661 | B1 | * | 6/2001 | Saitoh et al. | 399/117 |
| 6,349,189 | B1 | * | 2/2002 | Jeon | 399/119 |
| 6,463,232 | B1 | * | 10/2002 | Kawai et al. | 399/111 |

(Continued)

FOREIGN PATENT DOCUMENTS

| | | |
|---|---|---|
| TW | 504125 | 9/2002 |
| TW | 545863 | 8/2003 |

(Continued)

*Primary Examiner* — David Bolduc
(74) *Attorney, Agent, or Firm* — Jianq Chyun IP Office

(57) ABSTRACT

A sleeve and multi-function printer are provided. The multi-function printer includes a body, a roller and a pair of sleeves. The body includes multiple side-walls, wherein a pair of opposite side-walls, each has a protrusion. The roller is disposed in the body, and two ends of the roller are pivoted through the opposite side-walls. The sleeves are disposed on the ends of the rollers and correspondingly located on the opposite side-walls. Each of the sleeves has an annular body, a connection portion and a first extended end. The connection portion is coaxial and connected to the annular body. The first extended end is extended from the annular body along a radial direction of the annular body. The rotation length of the first extended portion is restricted by the protrusions.

12 Claims, 8 Drawing Sheets

(56) References Cited

U.S. PATENT DOCUMENTS

| | | | | |
|---|---|---|---|---|
| 6,480,687 | B1 * | 11/2002 | Kawai et al. | 399/111 |
| 7,082,274 | B2 * | 7/2006 | Saitoh et al. | 399/110 |
| 7,493,061 | B2 * | 2/2009 | Hatori et al. | 399/111 |
| 7,532,839 | B2 * | 5/2009 | Ishii | 399/111 |
| 8,219,000 | B2 * | 7/2012 | Kuma et al. | 399/121 |
| 8,380,106 | B2 * | 2/2013 | Gayne et al. | 399/117 |
| 2003/0061679 | A1 * | 4/2003 | Chang et al. | 16/2.1 |
| 2005/0169663 | A1 * | 8/2005 | Shintani et al. | 399/111 |
| 2007/0264042 | A1 * | 11/2007 | Mori | 399/106 |
| 2010/0308528 | A1 * | 12/2010 | Chung et al. | 271/117 |
| 2011/0013933 | A1 * | 1/2011 | Sato | 399/111 |
| 2011/0211863 | A1 * | 9/2011 | Watanabe et al. | 399/111 |
| 2011/0236051 | A1 * | 9/2011 | Kato | 399/90 |
| 2012/0195621 | A1 * | 8/2012 | Okabe | 399/90 |

FOREIGN PATENT DOCUMENTS

| | | |
|---|---|---|
| TW | M249379 | 11/2004 |
| TW | M315479 | 7/2007 |
| TW | 201043559 | 12/2010 |

* cited by examiner

SLEEVE AND MULTI-FUNCTION PRINTER

CROSS-REFERENCE TO RELATED APPLICATION

This application claims the priority benefit of Taiwan application serial no. 100126619, filed on Jul. 27, 2011. The entirety of the above-mentioned patent application is hereby incorporated by reference herein and made a part of this specification.

BACKGROUND

1. Field of the Invention

The invention relates to a sleeve and multi-function printer, and more particularly to, a sleeve capable of being shared by two ends of a roller and a multi-function printer using the same.

2. Description of Related Art

FIG. 1 is a schematic diagram illustrating a conventional sleeve and a conventional bushing used within a multi-function printer. Referring to FIG. 1, the convention sleeve 100 used within the multi-function printer has an annular body 110 and a restricting end 120 connected to the annular body 110, wherein a shape of the restricting end 120 generally appears as L, U and F being connected together. Moreover, the bushing 200 and the sleeve 100 sandwich a side wall (not shown), and the bushing 200 and the sleeve 100 are assembled together so that the sleeve 100 may be fixed within the multi-function printer.

FIG. 1 shows that the shape of the sleeve 100 is relatively special and has a directionality during application. Specifically, the sleeve 100 can only be used on one end of a roller instead of both ends, and thus unable to effectively lower a cost of the multi-function printer.

SUMMARY OF THE INVENTION

The invention provides a sleeve capable of being shared by two ends of a roller of a multi-function printer.

The invention provides a multi-function printer capable of effectively saving cost.

In order to achieve the abovementioned or other objectives, the invention provides a sleeve suitable to be disposed on a roller of a multi-function printer. A body of the multi-function printer has a protrusion. The sleeve has an annular body, a connection portion and a first extended end, wherein the connection portion and the annular body are coaxial and connected. The first extended end is extended from the annular body along a radial direction of the annular body and is restricted by the protrusion.

In an embodiment of the sleeve, a diameter of the connection portion is greater than a diameter of the annular body. In addition, the sleeve further includes a second extended end. The second extended end is extended from the annular body along a radial direction of the annular body, wherein the second extended end and the first extended end are located in a same extending direction of a diameter of the sleeve, but an extending direction of the second extended end and an extending direction of the first extended end are opposite.

In an embodiment of the sleeve, a shape and a size of the connection portion are the same as a shape and a size of the annular body. In addition, the sleeve further has a neck located between the connection portion and the annular body.

In an embodiment of the sleeve, the annular body and the connection portion share an opening.

In order to achieve the abovementioned or other objectives, the invention also provides a multi-function printer including a body, a roller and a pair of sleeves. The body includes multiple side-walls, wherein a pair of opposite side-walls, each has a protrusion. The roller is disposed in the body, and two ends of the roller are pivoted through the opposite side-walls. The sleeves are disposed on the two ends of the roller and are located on the opposite side-walls, wherein each of the sleeves has an annular body, a connection portion and a first extended end. The connection portion and the annular body are coaxial and connected. The first extended end is extending from the annular body along a radial direction of the annular body and is restricted by the protrusions of the opposite side-walls.

In an embodiment of the multi-function printer, a diameter of the connection portion of the sleeve is greater than a diameter of the annular body. In addition, the sleeve further includes a second extended end. The second extended end is extending from the annular body along a radial direction of the annular body, wherein the second extended end and the first extended end are located in a same extending direction of a diameter of the sleeve, but a extending direction of the second extended end and a extending direction of the first extended end are opposite. Furthermore, each of the opposite side-walls of the body has an engaging slot, and parts of the annular bodies of the sleeves are leaned within the corresponding engaging slots.

In an embodiment of the multi-function printer, a shape and a size of the connecting portion of the sleeve are the same as a shape and a size of the annular body of the sleeve. In addition, each of the sleeves has a neck connected between the connection portion and the annular body. Each of the opposite side-walls has an engaging slot, and the necks are correspondingly located in the engaging slots.

In an embodiment of the multi-function printer, the protrusions are located on outer surfaces of the opposite side-walls, and the connection portions of pair of sleeves are located inside the opposite side-walls.

In an embodiment of the multi-function printer, the annular body and the connection portion share an opening.

According to the foregoing, a shape of the sleeve of the invention is simpler than the conventional sleeve, and is capable of being shared by the two ends of the roller. Therefore, it is not required to design two different shapes of sleeves in correspondence to the two ends of the roller, and component and material usages may be economized. By using the sleeves of the invention in the multi-function printer, the cost of the multi-function printer may further be economized.

In order to make the aforementioned and other features and advantages of the invention comprehensible, several exemplary embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DETAILED DESCRIPTION OF DISCLOSED EMBODIMENTS

First Embodiment

Figure 1:
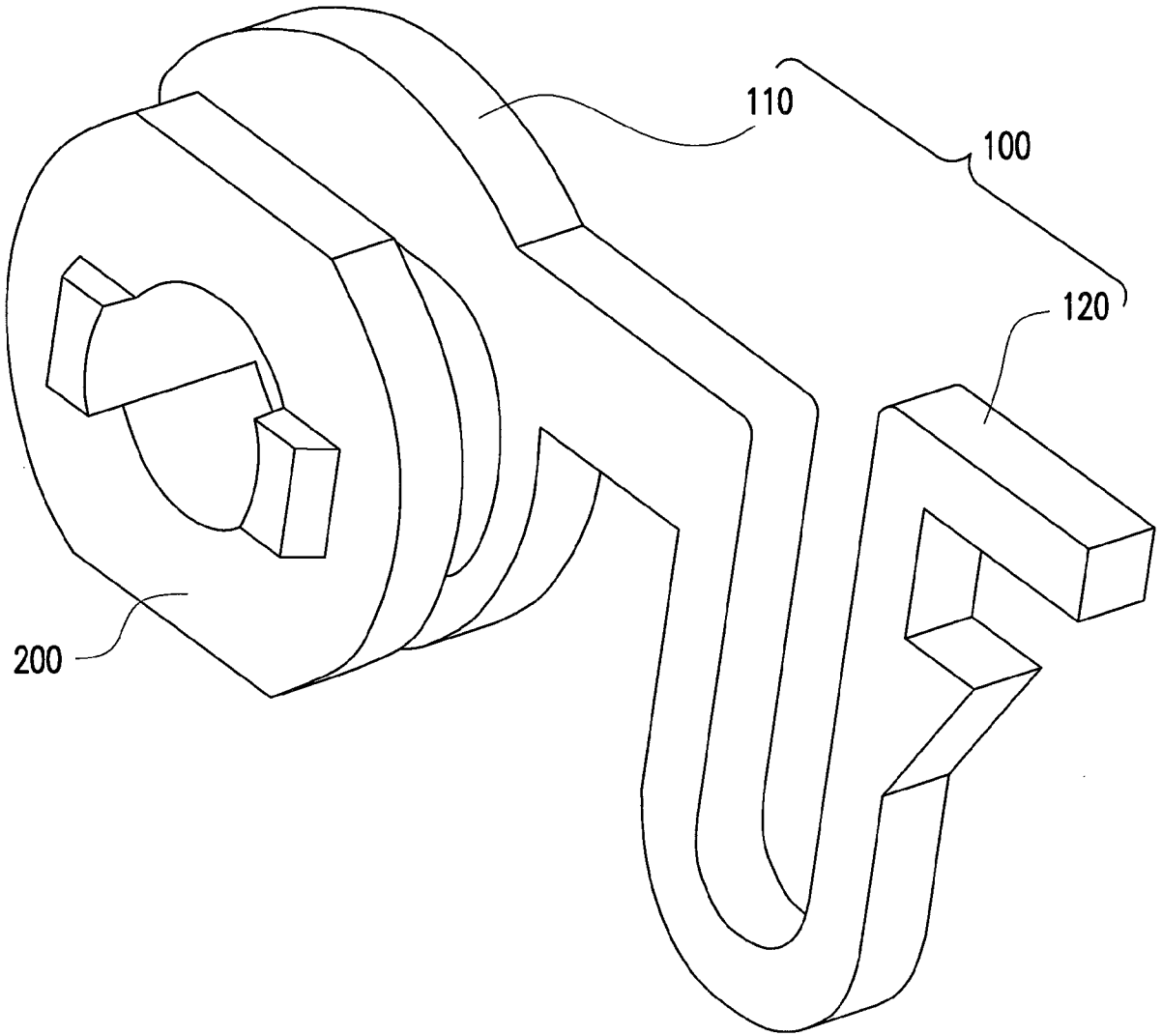
FIG. 1 (PRIOR ART)
FIG. 1 is a schematic diagram illustrating a conventional sleeve and a conventional bushing used within a multi-function printer.
Figure 2:
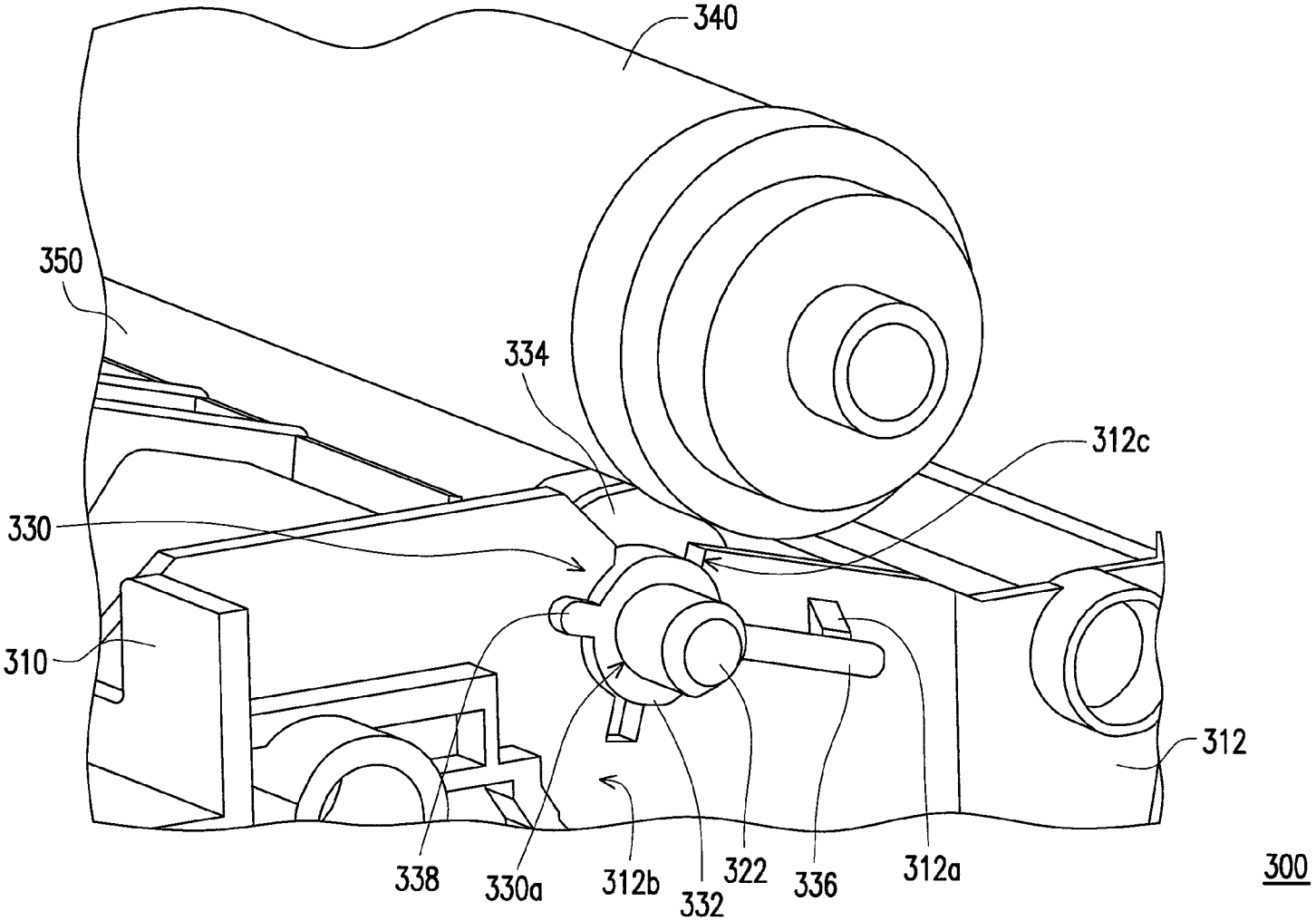
FIG. 2 is a partial schematic diagram illustration a multi-function printer according to a first embodiment.
Figure 3:
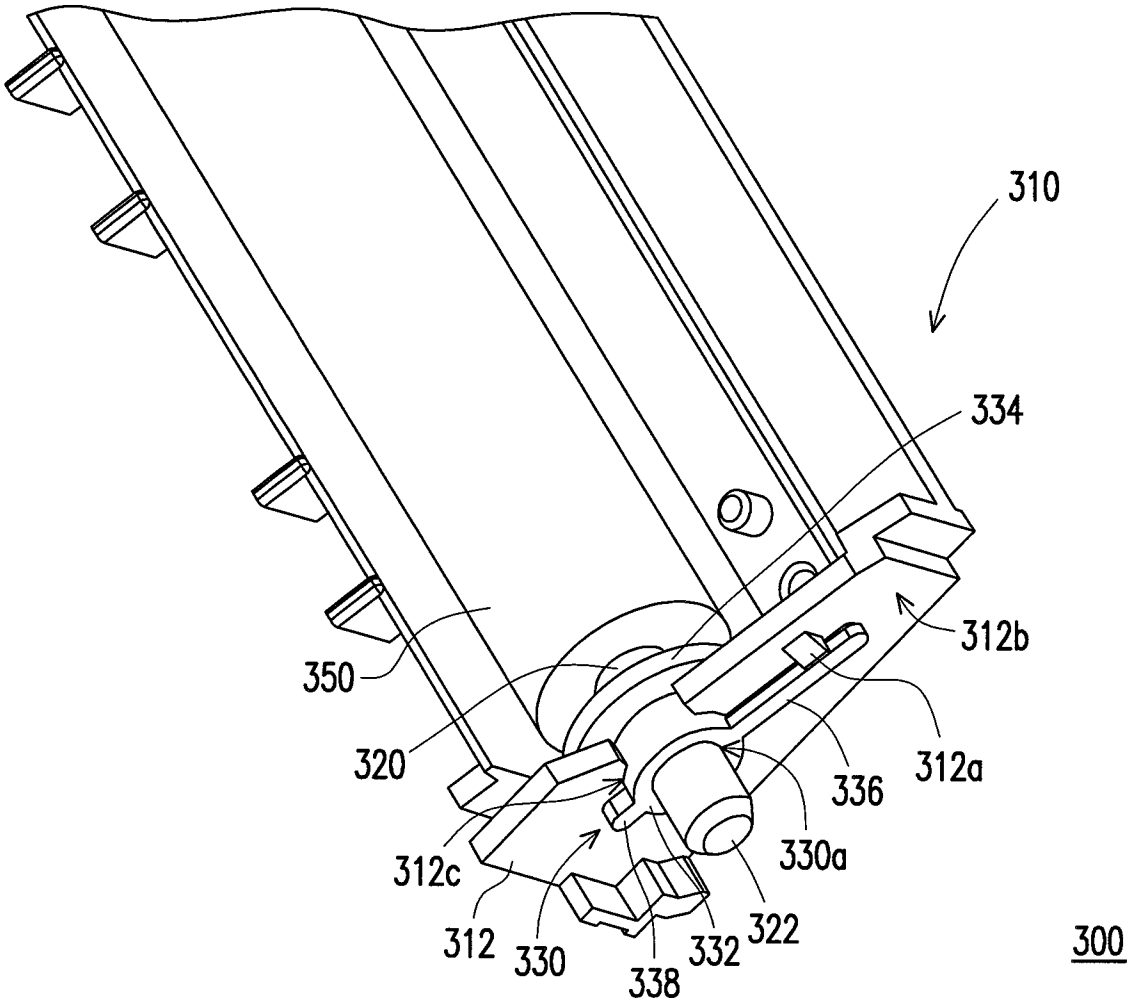
FIG. 3 is a schematic diagram illustrating the multi-function printer in FIG. 2 from another view angle.
Figure 4:
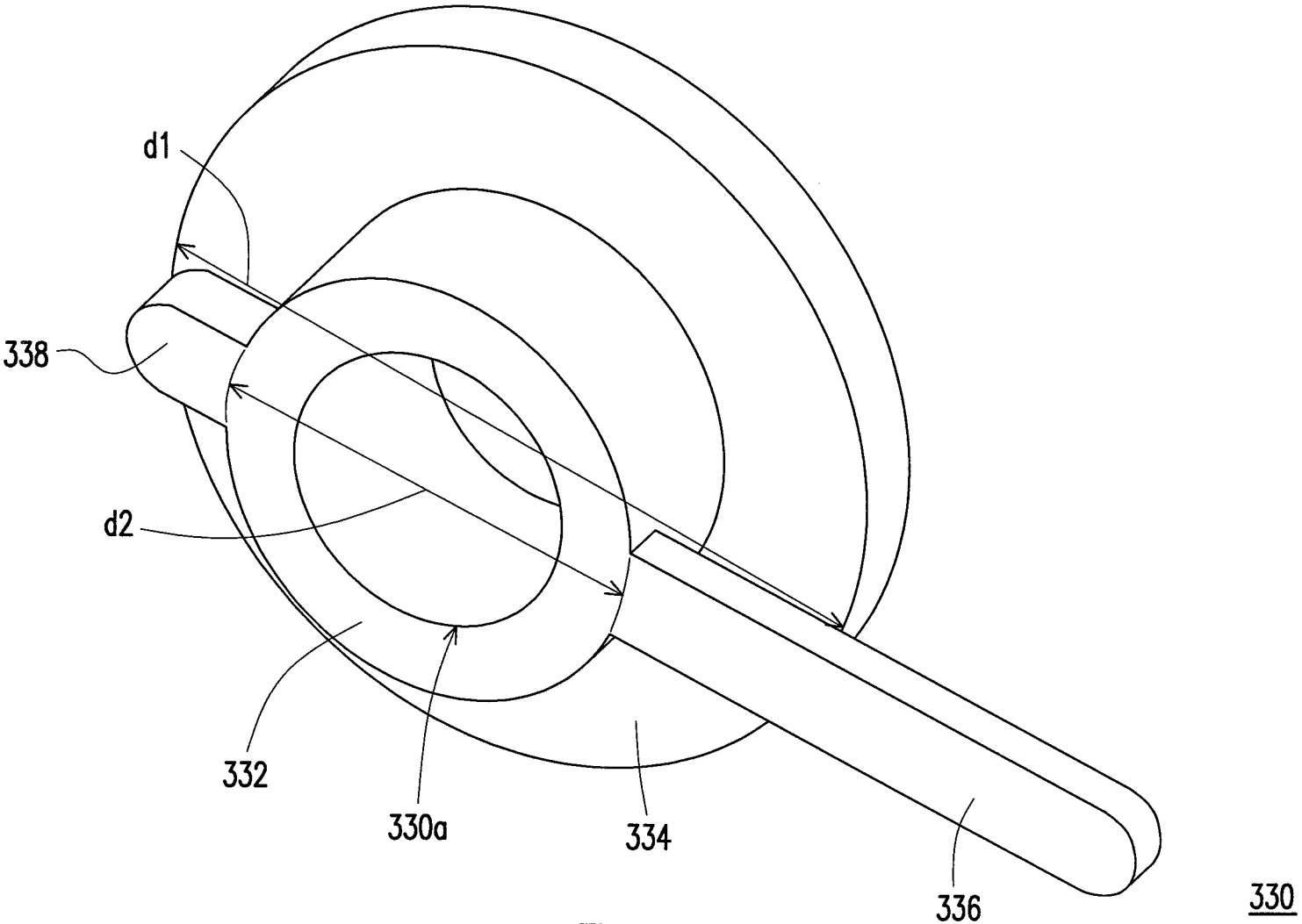
FIG. 4 is schematic diagram illustrating a bushing used in the multi-function printer in FIG. 2 and FIG. 3.

FIG. 2 is a partial schematic diagram illustration a multi-function printer according to a first embodiment, FIG. 3 is a schematic diagram illustrating the multi-function printer in FIG. 2 from another view angle, and FIG. 4 is schematic diagram illustrating a bushing used in the multi-function printer in FIG. 2 and FIG. 3. Referring to FIG. 2, FIG. 3 and FIG. 4 at the same time, a multi-function printer 300 includes a body 310, a roller 320 and a pair of sleeves 330 (only one sleeve 330 is shown in FIG. 2 and FIG. 3). The body 310 includes multiple side-walls 312 (only one is shown in FIG. 2 and FIG. 3), wherein a pair of side-walls 312, each has a protrusion 312*a*. The roller 320 is disposed in the body 310, and two ends 322 of the roller 320 are pivoted through the opposite side-walls 312. The sleeves 330 are disposed on the two ends 322 of the roller 320 and are correspondingly located on the opposite side-walls 312, wherein each of the sleeves 330 has an annular body 332, a connection portion 334 and a first extended end 336. The connection portion 334 and the annular body 332 are coaxial and connected. The first extended end 336 is extended from the annular body 332 along a radial direction of the annular body 332, and a rotation of the first extended end 336 is restricted by the protrusion 312*a* of the side-wall 312. In addition, although the present embodiment is taken the roller 320 as an example for the description, types of the roller 320 are not limited herein; general multi-function printers may be disposed with multiple types of rollers, such as a transcription roller, a paper feed roller, a paper output, photo drum, and the likes, which are all acted in a same manner. Moreover, other electronic devices may also have an application of roller; the sleeve 330 of the present embodiment may used in the multi-function printer or the electronic devices according to the needs. In other words, the application of the sleeve 330 is not limited to the present embodiment, which only uses the multi-function printer as an example for the purpose of description.

In detail, the protrusions 312*a* are located on outer surfaces 312*b* of the opposite side-walls. A material of the sleeve 330 is plastic. A diameter D1 of the connection portion 334 of the sleeve 330 is greater than a diameter D2 of the annular body 332. The connection portion 334 and the annular body 332 share an opening 330*a*, which is penetrated through by the end 322 of the roller 320. In addition, the first extended end 336 and the connection portion 334 of the sleeve 330 are separated by a distance (not shown), and the distance is exactly a thickness of the side-wall 312, such that the first extended end 336 and the connection portion 334 of the sleeve 330 are tightly disposed with the side-wall 312 when the sleeve 330 is fixed on the side-wall 312.

The sleeve 330 further includes a second extended end 338. The second end 338 is extended from the annular body 332 along a radial direction of the annular body 332. The second extended end 338 and the first extended end 336 may be located in a same radial direction of the sleeve 330 and are extended towards opposite directions. Namely, the first extended end 336 and the second extended end 338 are appeared to be 180 degree, wherein a distance between the second extended end 338 and the connection portion 334 is the same as a distance between the first extended end 336 and the connection portion 334, and a combined disposition between the second extended end 338, the first extended end 336 and the connection portion 334 may restrict the sleeve 330 on the side-wall 312, so that the sleeve 330 would not be displaced, along an axial direction of the sleeve 330, in relative to the side-wall 312.

The side-wall 312 may further has an engaging slot 312*c* for engaging the sleeve 330. When the sleeve 330 is assembled on the end 322 of the roller 320, and the sleeve 330 is engaged in the engaging slot 312*c* of the side-wall 312, the end 322 of the roller 320 is pivoted through at the side-wall 312, and a part of the annular body 332 is leaned within the engaging slot 312*c*, wherein the first extended end 336 and the second extended end 338 are located at the outer surface 312*b* of the side-wall 312, and the connection portion 334 is located inside the side-wall 312.

According to the above, when the roller 320 and another roller 340 are scrolling relatively closed to and in contact with each other, the protrusion 312*a* on the side-wall 312 prevents the first extended end 336 from moving along a rotational direction of the roller 320.

Next, referring to FIG. 2 to FIG. 4 at the same time, in particular, a rubber 350 is further disposed on the roller 320, wherein a contact area between the roller 340 and the rubber 350 disposed on the roller 320 varies according to difference between a diameter of the rubber 350 and the diameter of the connection portion 334.

Figure 5:
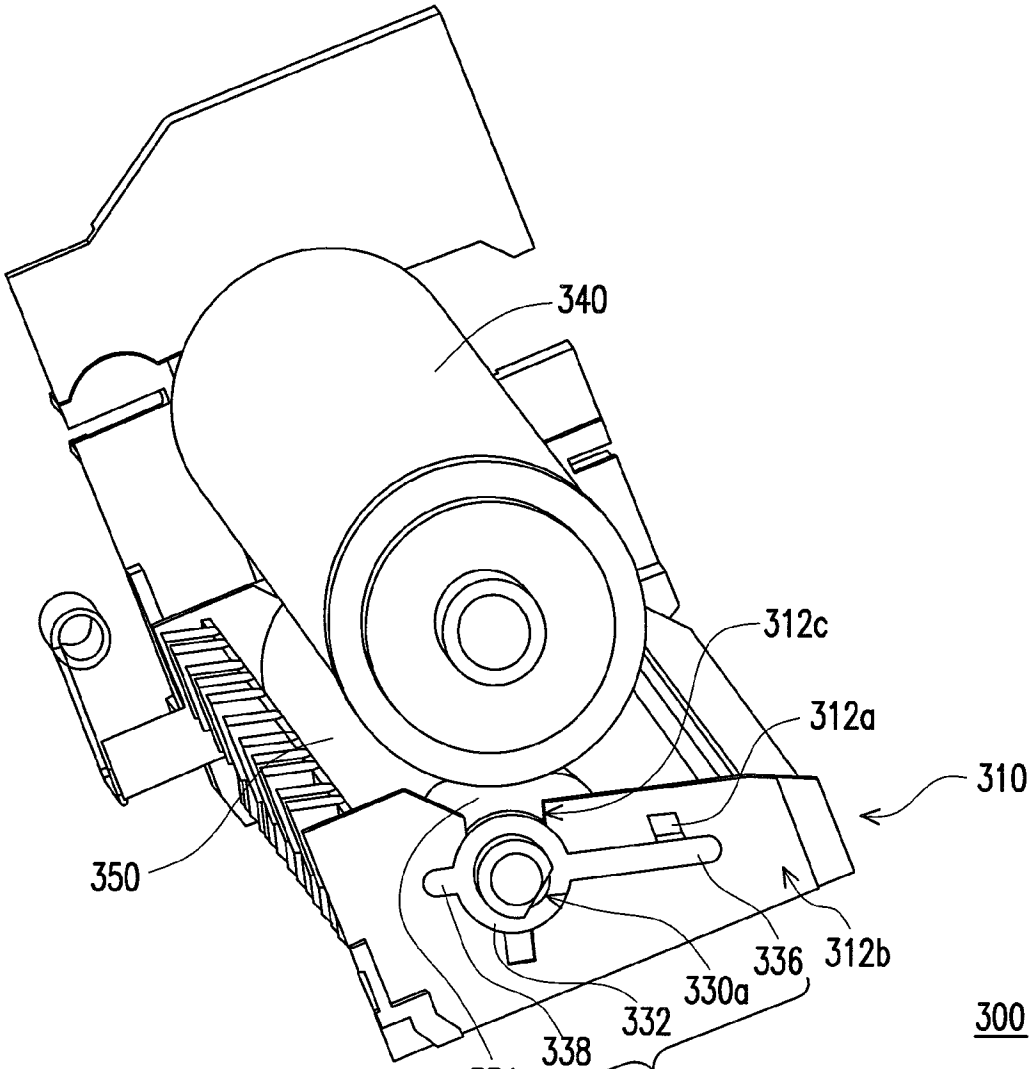
FIG. 5 and FIG. 6 are schematic diagrams illustrating different sides of the multi-function printer.
Figure 6:
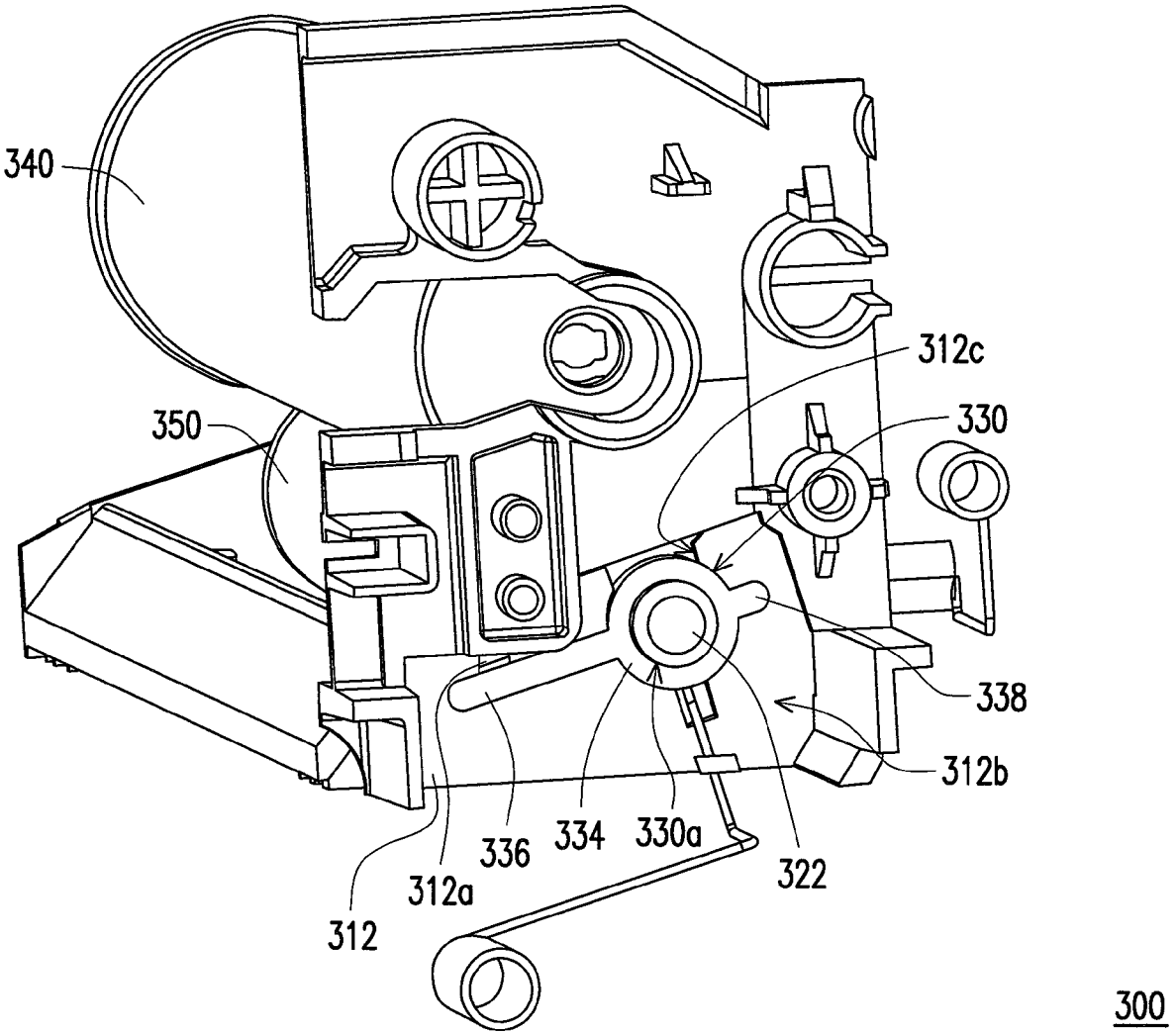

In comparison to a conventional sleeve, the sleeve 330 of the present embodiment has advantages of simple shape, easy forming and material saving. Moreover, the sleeve 330 of the present embodiment may be tightly disposed at the side-wall 312 by utilizing the shape of the sleeve 330, and thus no bushing is required to fixed the sleeve 330 on the side-wall 312. In addition, FIG. 5 and FIG. 6 are schematic diagrams illustrating different sides of the multi-function printer. Referring to FIG. 5 and FIG. 6, because the shape sleeve 330 is simple, the sleeve 330 may further be symmetrically shared by the two ends 322 of the roller 320, is not required to be designed differently targeting the left side or the right side roller 320, and may achieve advantages of saving design cost, component and material use, such that a production cost of the multi-function printer may be effectively economized.

Second Embodiment

Figure 7:
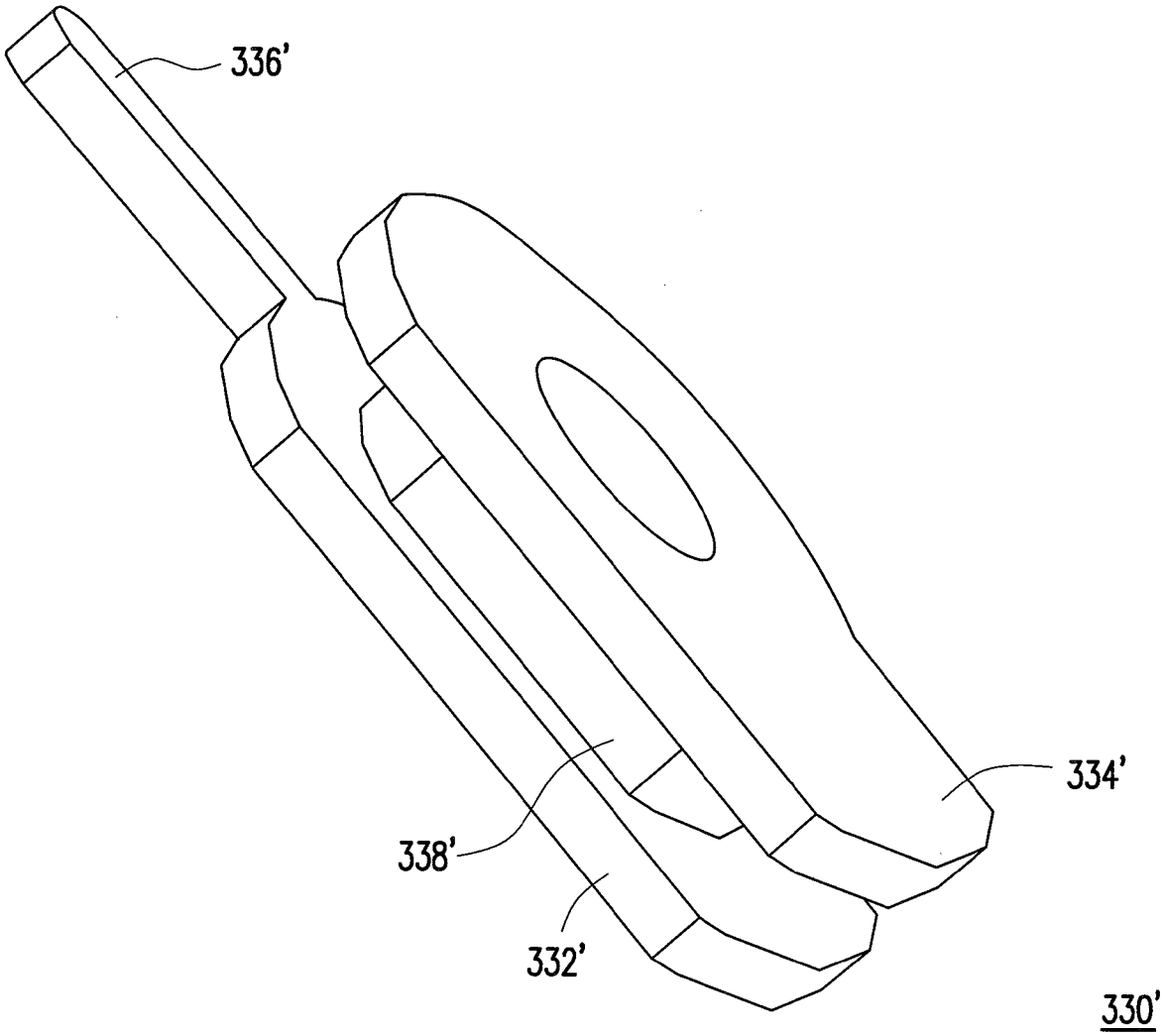
FIG. 7 is a schematic diagram illustrating a sleeve according to a second embodiment.
Figure 8:
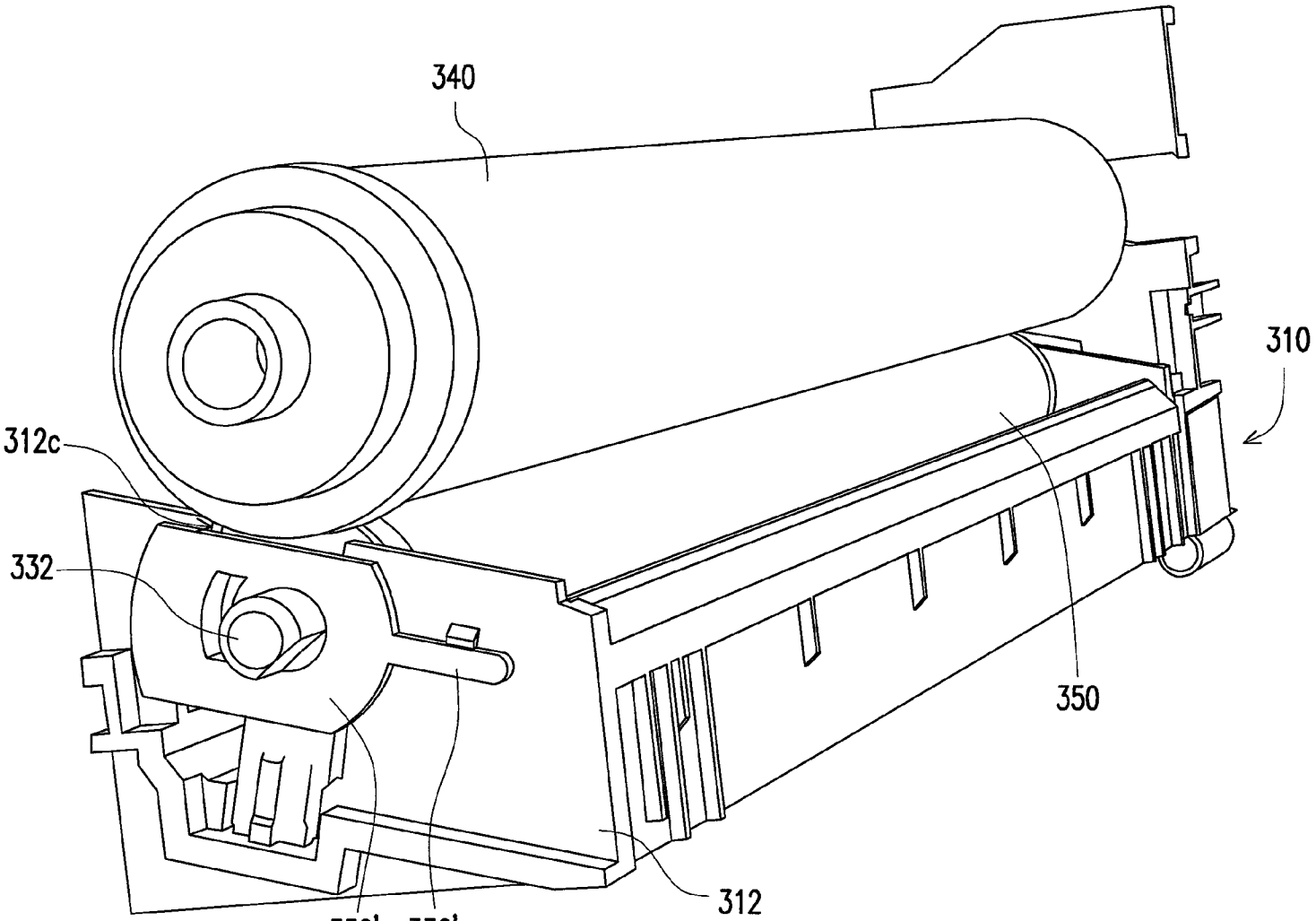
FIG. 8 is a schematic diagram illustrating an application of the sleeve in FIG. 7 in a multi-function printer.

The present embodiment is generally similar to the first embodiment, wherein a difference between the present embodiment and the first embodiment is that a shape of a sleeve 330' of the present embodiment is different form the shape the sleeve 330 of the first embodiment. FIG. 7 is a schematic diagram illustrating a sleeve according to a second embodiment, and FIG. 8 is a schematic diagram illustrating an application of the sleeve in FIG. 7 in a multi-function printer. Referring to FIG. 7 and FIG. 8 at the same time, a shape and a size of a connection portion 334' of the sleeve 330' is the same as a shape and a size of an annular body 332' of the sleeve 330' of the present embodiment. In addition, the sleeve 330' has a neck 338' connected between the connection portion 334' and the annular body 332'. When the sleeve 330' is engaged on the engaging slot 312*c* of the side-wall 312, the neck 338' is correspondingly leaned within the engaging slot 312*c*, and the connection portion 334' and the annular body 332' are respectively leaned at two sides of the side-wall 312.

In summary, the sleeve of the invention has the advantages of simple shape and easy forming, and is capable of being shared by the two ends of the roller, and thus the sleeve is not required to be designed differently targeting the respectively assembling sides of the roller. Therefore, the advantages of saving design cost, component and material use, such that the production cost of the multi-function printer may be effectively economized It will be apparent to those skilled in the art that various modifications and variations may be made to the structure of the invention without departing from the scope or spirit of the invention. In view of the foregoing, it is intended that the invention cover modifications and variations of this invention provided they fall within the scope of the following claims and their equivalents.

What is claimed is:

1. A sleeve suitable to be disposed on a roller of a multi-function printer, a body of the multi-function printer has a protrusion protruded from an outer surface of a side-wall of the body and a protruding direction of the protrusion is parallel to an axial direction of the roller, and the sleeve has an annular body, a connection portion, a neck connected between the connection portion and the annular body, a first extended end, and a second extended end formed integrally, wherein the connection portion and the annular body are coaxial and connected, and the first extended end and the second extended end are straightly extended from the annular body along a radial direction of the annular body towards opposite sides with different length, which forms a gap between the first extended end and the connection portion with the side-wall of the body being disposed therein, and is restricted by the protrusion.

2. The sleeve as recited in claim 1, wherein a diameter of the connection portion is greater than a diameter of the annular body.

3. The sleeve as recited in claim 1, wherein the second extended end and the first extended end are located in a same extending direction of a diameter of the sleeve, but an extending direction of second extended end and an extending direction of the first extended end are opposite.

4. The sleeve as recited in claim 1, wherein a shape and a size of the connection portion are the same as a shape and a size of the annular body.

5. The sleeve as recited in claim 1, wherein the annular body and the connection portion share an opening.

6. A multi-function printer comprising:

a body, including multiple side-walls, wherein a pair of opposite side-walls, each has a protrusion protruded from an outer surface of each of the side-walls;

a roller, disposed in the body, and two ends of the roller are pivoted through the opposite side-walls, wherein a protruding direction of the protrusions is parallel to an axial direction of the roller; and a pair of sleeves, disposed on the ends of the roller and correspondingly located on the opposite side-walls, wherein each of the sleeves has an annular body, a connection portion, a neck connected between the connection portion and the annular body, a first extended end, and a second extended end formed integrally, the connection portion and the annular body are coaxial and connected, and the first extended end and the second extended end are straightly extended from the annular body along a radial direction of the annular body towards opposite sides with different length and one of the first extended end and the second extended end is restricted by the protrusions of the opposite side-walls, a gap is formed between the first extended end and the connection portion while the connection portion is located inside the side-wall and the first extended end is located at the outer surface of the side-wall and the side-wall of the body being disposed in the gap.

7. The multi-function printer as recited in claim 6, wherein a diameter of the connection portion of the sleeve is greater than a diameter of the annular body.

8. The multi-function printer as recited in claim 7, wherein each of the opposite side-walls of the body has an engaging slot, and parts of the annular bodies of the sleeves are located within the corresponding engaging slots.

9. The multi-function printer as recited in claim 6, wherein a shape and a size of the connection portion of the sleeve are the same as a shape and a size of the annular body of the sleeve.

10. The multi-function printer as recited in claim 6, wherein each of the opposite side-walls has an engaging slot, and the necks are correspondingly located in the engaging slots.

11. The multi-function printer as recited in claim 6, wherein the protrusions are located on outer surfaces of the opposite side-walls, and the connection portions of the pair of sleeves are located inside the opposite side-walls.

12. The multi-function printer as recited in claim 6, wherein the annular body and the connection portion share an opening.

* * * * *